US006432324B1

(12) United States Patent
Yoshida et al.

(10) Patent No.: US 6,432,324 B1
(45) Date of Patent: Aug. 13, 2002

(54) SEMICONDUCTING MEMBER, FUNCTIONAL MEMBER FOR ELECTROPHOTOGRAPHY, AND PROCESS CARTRIDGE

(75) Inventors: Tatsurou Yoshida, Tsukuba; Kyoko Suzuki, Moriya-machi, both of (JP)

(73) Assignee: Canon Kasei Kabushiki Kaisha, Kukizaki-machi (JP)

( * ) Notice: Subject to any disclaimer, the term of this patent is extended or adjusted under 35 U.S.C. 154(b) by 5 days.

(21) Appl. No.: 09/645,040

(22) Filed: Aug. 24, 2000

(30) Foreign Application Priority Data

Aug. 25, 1999 (JP) ..... 11-238700
Jul. 13, 2000 (JP) ..... 2000-213087
Jul. 13, 2000 (JP) ..... 2000-213088

(51) Int. Cl.[7] ..... H01B 1/12; G03G 21/18; G03G 15/02

(52) U.S. Cl. ..... 252/500; 399/115; 399/176

(58) Field of Search ..... 252/500; 430/62, 430/57.3, 58.35; 399/159, 176, 115; 428/411.1, 474.4

(56) References Cited

U.S. PATENT DOCUMENTS 5,602,712 A * 2/1997 Daifuku et al. ..... 361/225
5,609,671 A 3/1997 Nagasawa ..... 106/20 R
5,910,385 A * 6/1999 Gardner et al. ..... 430/62
5,968,871 A * 10/1999 Katashima et al. ..... 503/227
5,980,784 A * 11/1999 Shimizu et al. ..... 252/500
5,993,694 A 11/1999 Ito et al. ..... 252/500
6,099,632 A 8/2000 Nagasawa et al. ..... 106/31.9

FOREIGN PATENT DOCUMENTS

| | | |
|---|---|---|
| JP | 48-018186 | 3/1973 |
| JP | 57-159856 | 10/1982 |
| JP | 8-3498 | 1/1996 |
| JP | 10-60108 | 3/1998 |
| JP | 10-110030 | 4/1998 |
| JP | 11-92703 | 4/1999 |
| JP | 11-148027 | 6/1999 |

* cited by examiner

*Primary Examiner*—Mark T. Kopec
(74) *Attorney, Agent, or Firm*—Fitzpatrick, Cella, Harper & Scinto

(57) ABSTRACT

A semiconducting member has a water-soluble polyaniline having an acidic group, and an aqueous polymeric compound. The semiconducting member has a volume resistivity of from $10^4$ Ω·cm to $10^{12}$ Ω·cm.

16 Claims, 4 Drawing Sheets

(1 of 4 Drawing Sheet(s) Filed in Color)

SEMICONDUCTING MEMBER, FUNCTIONAL MEMBER FOR ELECTROPHOTOGRAPHY, AND PROCESS CARTRIDGE

BACKGROUND OF THE INVENTION

1. Field of the Invention

This invention relates to a semiconducting member, a functional member for electrophotography and a process cartridge. More particularly, it relates to a semiconducting member containing a water-soluble polyaniline, and a functional member for electrophotography and a process cartridge which have such a semiconducting member.

2. Related Background Art

In recent years, with progress of electrophotographic techniques, there is an increasing demand for semiconducting members used in electrophotographic processing. In particular, elastic-rollers used in processing such as charging, developing and transfer attract notice. As semiconducting members used for such purposes, required are those having less uneven electrical resistivity depending on positions, having less dependence of electrical resistivity on applied voltage, having a small width of variations in electrical resistivity when used in environments of low temperature and low humidity and up to high temperature and high humidity and also having a small width of variations in electrical resistivity when used continuously for a long time.

The semiconducting members used for such purposes are comprised of a polymeric substance such as a polymeric elastomer or a polymeric foam in which a conductive material has been mixed. This conductive material is roughly grouped into a powdery material and a soluble (water-soluble) material.

Of these conductive materials, when the powdery material, e.g., carbon black powder or metal powder is used, the state of dispersion of inorganic conductive materials in thermoplastic resins is important because the mechanism by which it exerts conductivity relies on mutual contact of conductive material particles, and there has been a tendency of causing great changes in electrical resistivity depending on any slight difference in processing conditions and difference in mixing proportions. Also, even the same molded product may have a greatly uneven electrical resistivity depending on positions. Thus, it is difficult to obtain molded products showing stable semiconducting properties, in a good reproducibility. In general, in a system where the powdery material is added, phenomenons as stated above especially tend to occur in a semiconducting region ranging from $1\times10^4$ to $1\times10^{12}$ Ω·cm, and it is difficult to control electrical resistivity. Also, mixing the powdery material in a large proportion in order to achieve a lower electrical resistivity may cause a problem that products have a low mechanical strength and a rough surface. There is another problem that such a powdery material, having once been dispersed, again agglomerates in the thermoplastic resin to cause a change in electrical resistivity. Thus, the powdery materials have had problems caused by dispersion uniformity and stability.

As for the soluble material, it may include conducting agents comprised of inorganic ionic materials as exemplified by lithium perchlorate, sodium perchlorate and calcium perchlorate, and organic ionic materials as exemplified by cationic surface-active agents such as lauryltrimethylammonium chloride, stearyltrimethylammonium chloride, octadecyltrimethylammonium chloride, dodecyltrimethylammonium chloride, hexadecyltrimethylammonium chloride and modified fatty acid dimethylethylammonium ethosulfate, amphoteric surface-active agents such as laurylbetaine, stearylbetaine and dimethylalkyllaurylbetaine, and quaternary ammonium salts such as tetraethylammonium perchlorate, tetrabutylammonium perchlorate, tetrabutylammonium borofluoride; and polymeric members are also known which have been adjusted to have a stated resistivity, by mixing at least one of any of such conducting agents and an antistatic agent such as a hydrophilic polyether or polyester in the polymeric substance such as a polymeric elastomer or a polymeric foam. The polymeric members of this type, however, have a problem that they have a large width of variations in electrical resistivity when used in environments of low temperature and low humidity and up to high temperature and high humidity (i.e., have a poor environmental stability).

Thus, in these known conductive materials, it has been difficult to obtain semiconducting members that satisfy all of dispersion uniformity, dispersion stability and environmental stability.

The present inventors made extensive studies on conductive materials that can solve these problems. As the result, they have found that a water-soluble polyaniline is a conductive material which provides the semiconducting members that satisfy all of dispersion uniformity, dispersion stability and environmental stability.

Polyaniline as a conductive material is already known in the art. Its conductivity is imparted through protonic doping or oxidation doping. The polyaniline can be synthesized from relatively inexpensive monomers in a high yield. As to the form of its conductivity, it is well known that the polyaniline has good chemical properties and relatively high electrical conductivity and environmental stability.

However, the polyaniline has so stiff a backbone chain structure and so great a mutual action between high-molecular chains that it is commonly insoluble and infusible and has a disadvantage of being moldable or workable with difficulty.

In recent ten years or so, a large number of studies made on solubilization have brought about considerable progress, and development has been made on a polyaniline that is soluble in organic solvents and water and on methods for its working.

There is an example in which a conductive composition containing a polymeric compound including this water-soluble polyaniline is used in antistatic agents or the like. There, however, is no example in which it is used as an electrophotographic functional member required to have high-grade uniformity in conductivity and environmental stability.

SUMMARY OF THE INVENTION

An object of the present invention is to provide a semiconducting member which is readily controllable to a stated electrical resistivity, has less uneven electrical resistivity depending on positions, has a small width of variations in electrical resistivity when used in environments of low temperature and low humidity and up to high temperature and high humidity and also has a small width of variations in electrical resistivity when used continuously for a long time, and to provide a electrophotographic functional member and a process cartridge which have such a semiconducting member.

To achieve the above object, the present invention provides a semiconducting member comprising a water-soluble polyaniline having an acidic group, and an aqueous polymeric compound;

the semiconducting member having a volume resistivity of from $10^4$ Ω·cm to $10^{12}$ Ω·cm.

The present invention also provides a functional member for electrophotography, comprising a support and a functional layer;

the functional layer comprising a semiconducting member comprising a water-soluble polyaniline having an acidic group, and an aqueous polymeric compound;

the semiconducting member having a volume resistivity of from $10^4$ Ω·cm to $10^{12}$ Ω·cm.

The present invention also provides a process cartridge comprising an electrophotographic photosensitive member and a functional member;

the electrophotographic photosensitive member and functional member being supported as one unit and being detachably mountable to the main body of an electrophotographic apparatus;

the functional member comprising a support and a functional layer;

the functional layer comprising a semiconducting member comprising a water-soluble polyaniline having an acidic group, and an aqueous polymeric compound;

the semiconducting member having a volume resistivity of from $10^4$ Ω·cm to $10^{12}$ Ω·cm.

BRIEF DESCRIPTION OF THE DRAWINGS

The file of this patent contains at least one drawing executed in color. Copies of this patent with color drawings will be provided by the Patent and Trademark Office upon request and payment of the necessary fee.

DESCRIPTION OF THE PREFERRED EMBODIMENTS

Figure 1:
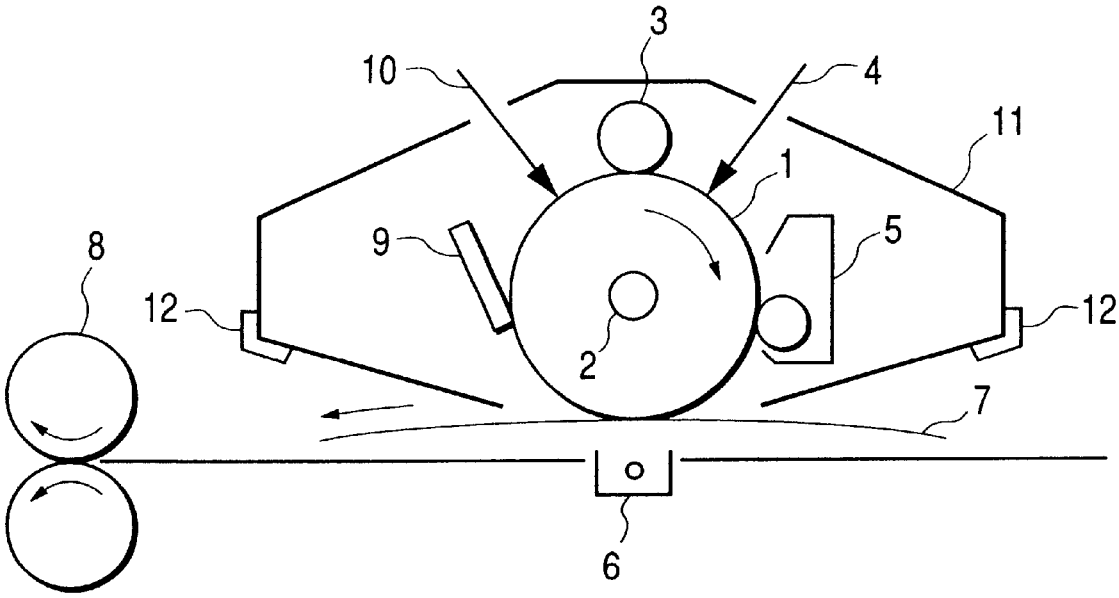
FIG. 1 is a schematic illustration of the construction of an electrophotographic apparatus having the process cartridge of the present invention.

The semiconducting member of the present invention comprises i) a water-soluble polyaniline having an acidic group ii) and an aqueous polymeric compound, and also has a volume resistivity of from $10^4$ Ω·cm to $10^{12}$ Ω·cm.

In the present invention, the combination of a water-soluble polyaniline with an aqueous polymeric compound makes the water-soluble polyaniline compatible or makes it present as very uniform and fine particles, and hence high-quality images can be provided when used as a functional member for electrophotography.

The present invention will be described below in detail.

The water-soluble polyaniline used in the present invention contains an acidic group in order to exert solubility in water (water-solubility). The acidic group may include a sulfonyl group or a carboxyl group. A sulfonyl group is particularly preferred.

The basic skeleton of polyaniline is exemplified in Susumu Yoshimura, "Conductive Polymers", pp.17–18, compiled by The Society of Polymer Science, Japan. In the water-soluble polyaniline used in the present invention, the acidic group for exerting water-solubility may directly be bonded to any atom in the polyaniline skeleton, and any functional group other than the acidic group may also be bonded. Stated specifically, the polyaniline may include, but not limited to, those disclosed in, e.g., Japanese Patent Application Laid-open No. 10–110030 and No. 10–060108.

The polyaniline may be in a doped state of any of a self-doped type and an externally doped type, without any particular limitations. Dorpants used in the case of the externally doped type may be any negative ions of protonic acid.

The negative ions of protonic acid include mono- to trivalent negative ions such as a chlorine ion, a bromine ion, an iodine ion, a nitrate ion, a sulfate ion, a phosphate ion, a borofluoride ion, a perchlorate ion, a thiocyanate ion, an acetate ion, a propionate ion, a p-toluenesulfonate ion, a trifluoroacetate ion and a trifluoromethane sulfonate ion. Mono- or divalent negative ions are preferred.

To make up a composition for forming the combination of the water-soluble polyaniline having an acidic group with the aqueous polymeric compound according to the present invention (hereinafter simply "composition"), the water-soluble polyaniline and the aqueous polymeric compound may directly be mixed. Alternatively, in order to provide compatibility, a solvent may be added to dissolve the water-soluble polyaniline and the aqueous polymeric compound so as to be used in the form of a solution. As the solvent used therefor, water or a mixed system of water and an organic solvent compatible with the water may be used. In the mixed system, a state having a large water content is especially preferable for the dissolution of the water-soluble polyaniline.

As specific examples of the organic solvent, it may include alcohols such as methanol, ethanol, propanol and isopropanol, ketones such as acetone and methyl isobutyl ketone, cellosolves such as methyl cellosolve and ethyl cellosolve, propylene glycols such as methylpropylene glycol and ethylpropylene glycol, amides such as dimethylformamide and dimethylacetamide, pyrrolidones such as N-methylpyrrolidone and N-ethylpyrrolidone, and hydroxyl esters such as ethyl lactate, methyl lactate, methyl β-methoxyisolactate, methyl α-hydroxyisolactate, ethyl α-hydroxyisolactate and methyl α-methoxyisolactate. Alcohols, propylene glycols, amides and pyrrolidones may preferably be used, and alcohols may more preferably be used. The use of such an organic solvent or a solvent containing the organic solvent enables improvement in coating properties of the composition when coated on a substrate.

The aqueous polymeric compound used in the present invention may include water-soluble polymeric compounds whose polymers are completely soluble in water, and aqueous emulsion-forming polymeric compounds obtained by emulsion polymerization.

As specific examples of the water-soluble polymeric compounds, they may include polyvinyl alcohols such as polyvinyl alcohol, polyvinyl formal and polyvinyl butyral; polyacrylamides such as polyacrylamide, poly(N-methylolacrylamide) and polyacrylamide methylpropanesulfonic acid; and also polyvinyl pyrtolidones, water-soluble alkyd resins, water-soluble amide resins, water-soluble melamine resins, water-soluble urea resins, water-soluble phenolic resins, water-soluble epoxy resins, water-soluble polybutadiene resins, water-soluble acrylic resins, water-soluble urethane resins, water-soluble acrylic/styrene copolymer resins, water-soluble vinyl acetate/acrylic copolymer resins, water-soluble polyester resins, water-soluble styrene/maleic acid copolymer resins, water-soluble fluorine resins, and copolymers of these. Among these, water-soluble amide resins are particularly preferred.

As specific examples of the aqueous emulsion-forming polymeric compounds, they may include aqueous alkyd resins, aqueous amide resins, aqueous melamine resins, aqueous urea resins, aqueous phenolic resins, aqueous epoxy resins, aqueous polybutadiene resins, aqueous acrylic resins, aqueous urethane resins, aqueous styrene/acrylic copolymer resins, aqueous vinyl acetate resins, aqueous vinyl acetate/acrylic copolymer resins, aqueous polyester resins, aqueous styrene/maleic acid copolymer resins, aqueous acrylic-silica resins, aqueous fluorine resins, and copolymers of these. Any of these polymeric compounds may be used alone, or may also be used in the form of a mixture of two or more types in any desired proportion. Of these, aqueous urethane resins, aqueous styrene/acrylic copolymer resins, and aqueous acrylic resins are particularly preferred.

The water-soluble polyaniline (hereinafter "(a)"), the aqueous polymeric compound (hereinafter "(b)") and the solvent (hereinafter "(c)") which are used in the present invention may be used in a proportion not particularly limited. However, with respect to the total weight of the mixture comprising the water-soluble polyaniline, the aqueous polymeric compound and the solvent, 0.5 to 50% by weight of the (b) is preferred and not more than 95% by weight of the (c) is preferred. If the (b) is in a too small proportion, film-forming properties, molding properties, strength, wear resistance and so forth may lower, or the composition tends to have a poor adhesion to substrates. If on the other hand the (b) is in a too large proportion, a poor conductivity tends to result. Also, if the (c) is in a too large proportion, it follows that the solid content is in a low proportion, making it difficult to control layer thickness when used as a coating fluid, to tend to result in poor coating properties.

The volume resistivity of the semiconducting member of the present invention, comprising the water-soluble polyaniline and the aqueous polymeric compound, is so controlled as to be within the range of from $10^4$ Ω·cm to $10^{12}$ Ω·cm.

In the present invention, a cross-linking agent may preferably be used in order to more prevent the water-soluble polyaniline from bleeding.

The cross-linking agent usable in the present invention effects cross-linking between cross-linking agents or between a cross-linking agent and the aqueous polymeric compound to bring about an improvement in the effect of preventing the water-soluble polyaniline from bleeding from coating films. Such a cross-linking agent may be any of those capable of making the cross-linking reaction proceed at the time of coating film formation, and there are no particular limitations. Preferred are those capable of making the cross-linking reaction proceed by heating at a relatively low temperature, and making the coating film formed have a good resistance to water. Also, hydrophilic cross-linking agents are preferred because of their better miscibility at the time of compounding than hydrophobic ones. As examples of the cross-linking agent usable in the present invention, it may include, but not particularly limited to, melamine compounds, phenolic compounds, urea compounds, and epoxy compounds, organic hydrazine compounds, isocyanate compounds and oxazoline compounds, having at least two residues (residual groups). It may preferably be a melamine compound or an epoxy compound. These cross-linking agents may each be used alone, or may also be used in the form of a mixture of two or more types in any desired proportion.

Since the water-soluble polyaniline used in the present invention has an acidic group, it acts not only as a conducting agent but also as a catalyst of the cross-linking agent. Hence, the cross-linking reaction proceeds even without addition of any additional cross-linking catalyst, thus such use is preferred, but may be used in combination with an additional cross-linking catalyst.

The aqueous polymeric compound used in the present invention may also preferably have a cross-linkable functional group. The cross-linkable functional group facilitates the cross-linking reaction with the hydrophilic cross-linking agent used in the present invention, when coating films are formed. Thus, a higher crosslink density is achievable than the case when the aqueous polymeric compound has no cross-linkable functional group, and therefore, the effect of preventing the bleeding of the water-soluble polyaniline from the coating film may be improved. This cross-linkable functional group may be any of those capable of making the cross-linking reaction proceed at the time of coating film formation, and there are no particular limitations. Preferred are groups represented by the following Formula (1), capable of making the cross-linking reaction proceed by heating at a relatively low temperature and making the coating film formed have a good resistance to water:

$$—NH—CH_2—OR^1 \quad (1)$$

(wherein $R^1$ represents a hydrogen atom or an alkyl group having 1 to 6 carbon atoms) or an epoxy group and a vinyl group. It may also include a urethane group, an isocyanate group, an amino group and an alkyleneoxy group. There are no particular limitations on the proportion of the cross-linkable functional group in the aqueous polymeric compound. However, its use in a too large proportion is not preferable because the composition may have a low stability at the time of compounding and storage and also the composition obtained tends to have a low conductivity.

The water-soluble polyaniline (hereinafter "(a)"), the aqueous polymeric compound (hereinafter "(b)"), the cross-linking agent (hereinafter "(c)") and the solvent (hereinafter "(d)") in the above composition usable in the present invention may be used in a proportion not particularly limited. However, with respect to the total weight of the mixture comprising the water-soluble polyaniline, the aqueous polymeric compound, the cross-linking agent and the solvent, 0.5 to 50% by weight of the (b) is preferred, 0.05 to 40% by weight, particularly 1 to 40% by weight of the (c) is preferred and not more than 95% by weight of the (d) is preferred. If the (b) is in a too small proportion, film-forming properties, molding properties, strength, wear resistance and so forth may lower, or the composition tends to have a poor adhesion to substrates. If on the other hand the (b) is in a too large proportion, a poor conductivity tends to result. Also, if the (c) is in a too small proportion, the effect of preventing the bleeding may be exhibited with difficulty, and, if it is in a too large proportion, a poor conductivity tends to result. Thus, it is important to balance the quantity of the (c). Also, if the (d) is in a too large proportion, it follows that the solid content is in a low proportion to make it difficult to control layer thickness when used as a coating fluid, resulting in a poor coating performance.

In the present invention, the semiconducting member may also preferably contain a hydrophilic powder in order for the semiconducting member to be improved in environmental stability of its volume resistivity.

The hydrophilic powder usable in the present invention may include, but not particularly limited to, carbon black powder and metal oxide powder. Carbon black powder is preferred. In particular, carbon black having been subjected to particle-surface oxidation treatment (i.e., surface-oxidized) may preferably be used as the hydrophilic powder. The surface oxidation treatment may be made by a method including, but not particularly limited to, e.g., a method disclosed in Japanese Patent Application Laid-open No. 48-18186 in which a hypohalogenite is used and a method disclosed in Japanese Patent Application Laid-open No. 57-159856 in which low-temperature oxidation plasma treatment is made. On account of such surface treatment, hydroxyl groups or carboxyl groups, having active hydrogen, can be produced at the surface in a large number to bring about an improvement in hydrophilicty of the carbon black itself. Also, it is considered that surface area can be made larger at the same time and the dispersibility in water can be improved.

There are also no particular limitations on the amount of active hydrogen of the carbon black having been surface-oxidized and on the manner for its measurement. For example, Japanese Patent Application Laid-open No. 8-3498 discloses carbon black having an active hydrogen content of 1.5 mmol/g or more as measured by the Zeisel method; Japanese Patent Application Laid-open No. 11-92703, carbon black i) the surface oxygen concentration as measured by X-ray photoelectron spectroscopy of which is 0.07 or higher as the ratio of the number of atoms on the basis of carbon atoms and ii) the sum of surface carboxyl group carbon concentration and surface hydroxyl group carbon concentration as measured by X-ray photoelectron spectroscopy of which is 0.5% or more; and Japanese Patent Application Laid-open No. 11-148027, carbon black the total sum of carboxyl groups and hydroxyl groups of which is 3 $\mu eq/m^2$ or more per unit surface area when the carboxyl groups are measured by a neutral titration test and the hydroxyl groups are measured with an ultraviolet light spectrophotometer.

The reason why the addition of hydrophilic powder brings about an improvement in the environmental stability of electrical resistivity of the semiconducting member. It, however, has been confirmed that its addition makes the semiconducting member have a low water absorption. Thus, it is presumed that the addition of the hydrophilic powder keeps the water absorption from varying to bring about an improvement in the environmental stability of electrical resistivity.

The water-soluble polyaniline (hereinafter "(a)"), the aqueous polymeric compound (hereinafter "(b)"), the hydrophilic powder (hereinafter "(c)"), the cross-linking agent (hereinafter "(d)") and the solvent (hereinafter "(d)") in such a composition usable in the present invention may be used in a proportion not particularly limited. However, with respect to the total weight of the mixture comprising the water-soluble polyaniline, the aqueous polymeric compound, the hydrophilic powder, the cross-linking agent and the solvent, 0.5 to 50% by weight of the (b) is preferred, 0.05 to 40% by weight, particularly 1 to 40% by weight of the (c) is preferred, 0.05 to 40% by weight, particularly 1 to 40% by weight of the (d) is preferred and not more than 95% by weight of the (e) is preferred. If the (b) is in a too small proportion, film-forming properties, molding properties, strength, wear resistance and so forth may lower, or the composition tends to have a poor adhesion to substrates. If on the other hand the (b) is in a too large proportion, a poor conductivity tends to result. Also, if the (c) is in a too small proportion, the effect of improving the environmental stability of resistivity may be exhibited with difficulty, and, if it is in a too large proportion, other physical properties tend to lower. Also, if the (d) is in a too small proportion, the effect of preventing the bleeding may be exhibited with difficulty, and, if it is in a too large proportion, a poor conductivity tends to result. Also, if the (e) is in a too large proportion, it follows that the solid content is in a low proportion to make it difficult to control layer thickness when used as a coating fluid, resulting in a poor coating performance.

The water-soluble polyaniline having an acidic group, used in the present invention, may preferably be used in the state of an aqueous solution prepared by adjusting its pH with ammonia to a suitable value ranging from 4 to 12. Such operation is made in order to prevent the water-soluble polyaniline and aqueous polymeric compound from undergoing agglomeration due to pH shock, to improve miscibility. At the same time, it is also done in order to prevent the hydrophilic powder from undergoing agglomeration due to cross-linking reaction caused in the state of solution by the acidic group of the water-soluble polyaniline, to improve coating stability.

The composition used to form the conducting member of the present invention is applied to the surface of a substrate by a method commonly used for coating. For example, usable are, but by no means limited to, coating methods such as gravure coating, roll coating, curtain coating, spin coating, bar coating, reverse coating, kiss-roll coating, fountain roll coating, rod coating, air doctor coating, knife coating, blade coating, cast coating and screen coating, spraying methods such as spray coating, and dipping methods such as dip coating.

After a semiconductive polymeric film is formed on the substrate, the film may be heated. It may preferably be heated at a temperature of 250° C. or below, and more preferably heated at a temperature ranging from 40 to 200° C. Especially in order to make the cross-linking reaction proceed completely, a temperature range of from 120° C. to 170° C. is particularly preferred. If heated at above 250° C., the component (a) may deteriorate to lower conductivity. If it is not heated, the cross-linking reaction may proceed at a very low rate.

The functional member for electrophotography of the present invention comprises a support and provided thereon a functional layer containing the semiconducting member described above. Stated specifically, it is used in, e.g., elastic rollers used in processing such as charging, developing and transfer. The semiconducting member may be worked into a member for electrophotography by a method including, but not particularly limited to, e.g., a method in which a composition comprised of the aqueous polymeric compound containing the water-soluble polyaniline is directly coated on a different member followed by drying, and a method in which the composition described above is formed into a film on a different substrate, and thereafter combined with a different member.

As known from conventional various publications, the elastic roller usually has an elastic layer on a support, and optionally further has a resistance layer or a coating layer on the elastic layer. The semiconducting member of the present invention may be used in any of these layers, but may preferably be used in the resistance layer or the coating layer.

FIG. 1 schematically illustrates the construction of an electrophotographic apparatus having a process cartridge having the functional member for electrophotography of the present invention as a charging roller.

In FIG. 1, reference numeral 1 denotes a drum type electrophotographic photosensitive member, which is rotatingly driven around an axis 2 in the direction of an arrow at a stated peripheral speed. The photosensitive member 1 is uniformly electrostatically charged on its periphery to a positive or negative, given potential through a primary charging means 3 making use of the functional member of the present invention. The photosensitive member thus charged is then exposed to light 4 emitted from an exposure means (not shown) for slit exposure or laser beam scanning exposure. In this way, electrostatic latent images are successively formed on the periphery of the photosensitive member 1.

The electrostatic latent images thus formed are subsequently developed by toner by the operation of a developing means 5. The resulting toner-developed images are then successively transferred by the operation of a transfer means 6, to the surface of a transfer medium 7 fed from a paper feed section (not shown) to the part between the photosensitive member 1 and the transfer means 6 in the manner synchronized with the rotation of the photosensitive member 1.

The transfer medium 7 on which the images have been transferred is separated from the surface of the photosensitive member, is led through an image fixing means 8, where the images are fixed, and is then printed out of the apparatus as a copied material (a copy).

The surface of the photosensitive member 1 from which images have been transferred is brought to removal of the toner remaining after the transfer, through a cleaning means 9. Thus the photosensitive member is cleaned on its surface, further subjected to charge elimination by pre-exposure light 10 emitted from a pre-exposure means (not shown), and then repeatedly used for the formation of images. When the primary charging means 3 is a contact charging means making use of a charging roller, the pre-exposure is not necessarily required.

In the present invention, the apparatus may be constituted of a combination of plural components integrally joined as a process cartridge from among the constituents such as the above electrophotographic photosensitive member 1, primary charging means 3, developing means 5 and cleaning means 9 so that the process cartridge is detachably mountable to the body of the electrophotographic apparatus such as a copying machine or a laser beam printer. For example, the primary charging means 3 may be integrally supported in a cartridge together with the photosensitive member 1 to form a process cartridge 11 that is detachably mountable to the body of the apparatus through a guide means such as a rail 12 provided in the body of the apparatus.

In the case when the electrophotographic apparatus is a copying machine or a printer, the exposure light 4 is light reflected from, or transmitted through, an original, or light irradiated by the scanning of a laser beam, the driving of an LED array or the driving of a liquid crystal shutter array according to signals obtained by reading an original through a sensor and converting the information into signals.

According to the present invention, the semiconducting member has a superior uniformity in electrical resistivity, and hence the electrophotographic apparatus making use of such a member can provide very good images free of uneven density for both solid and halftone images. The semiconducting member according to the present invention can be handled with ease because it is less affected by any environmental variations caused by the addition of the conducting agent and may cause no bleading of the conducting agent.

The present invention will be described below in greater detail by giving Examples. The present invention is by no means limited to only these Examples.

EXAMPLE 1

Figure 2:
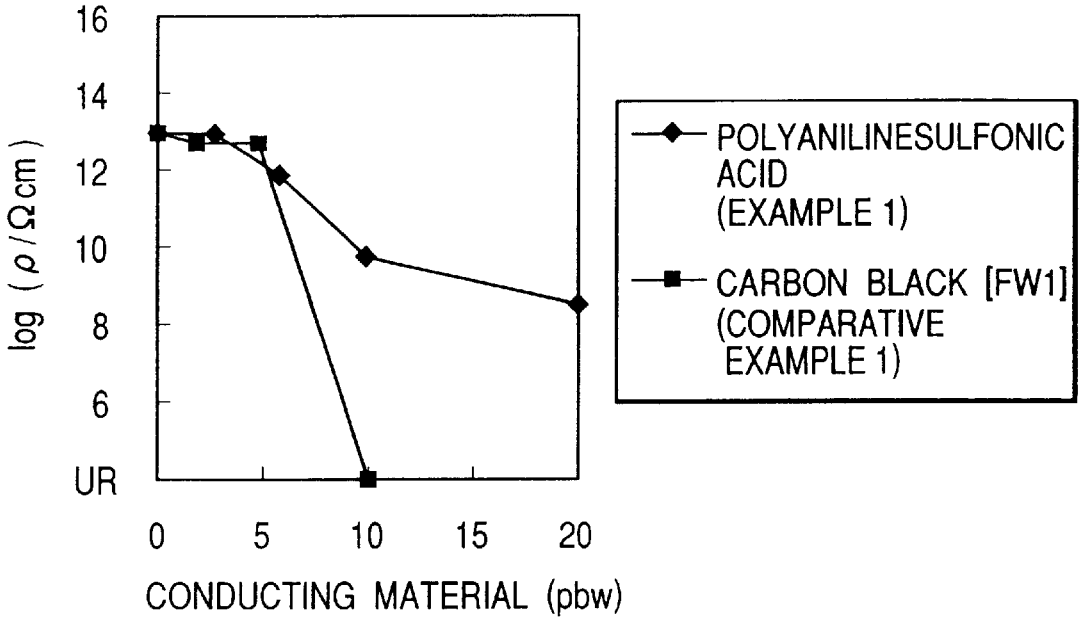
FIG. 2 is a graph where volume resistivities at 23° C./60%RH of films prepared in Example 1 and Comparative Example 1 are plotted with respect to amounts of a conducting agent.

Polyanilinesulfonic acid (available from Mitsubishi Rayon Co., Ltd.) and 100 parts by weight of polyvinyl alcohol PVA-117 (trade name; available from Kuraray Co., Ltd.) were dissolved with stirring at room temperature together with 1,000 parts by weight of water in solid-content compositional ratios shown in FIG. 2, to prepare compositions. The compositions thus obtained were each cast-coated in an aluminum container, followed by drying at 80° C. Thus, smooth films each having a layer thickness of about 100 $\mu$m were obtained. Their volume resistivities were measured with a resistance meter HIRESTER (manufactured by Dia Instruments K.K.) at an applied voltage of 100 V in the environment of 23° C./60% RH. Results obtained are shown together in FIG. 2.

EXAMPLE 2

Figure 3:
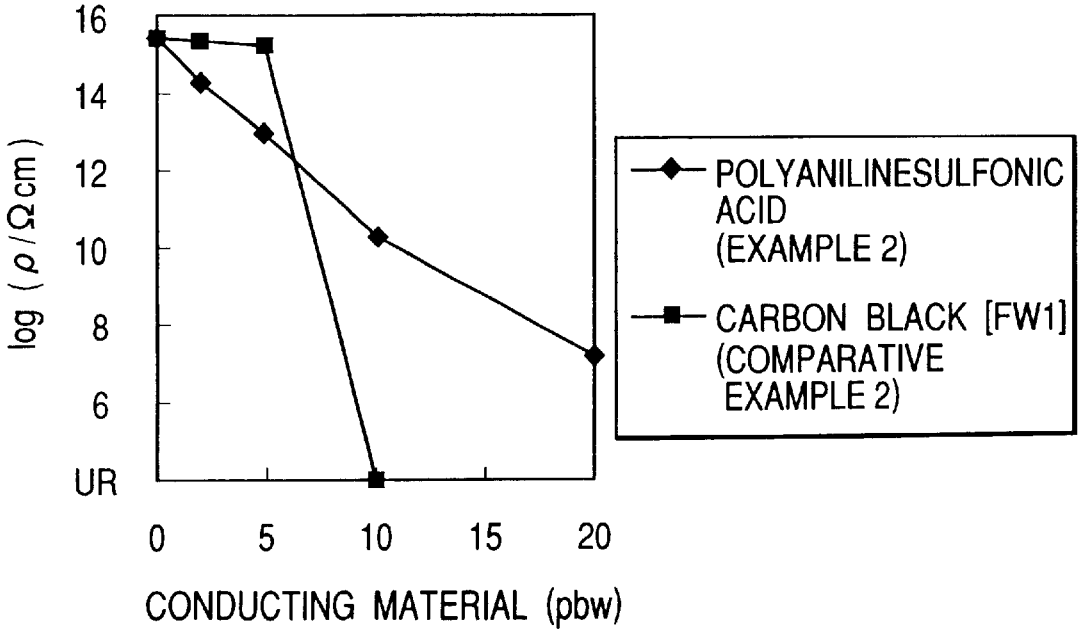
FIG. 3 is a graph where volume resistivities at 23° C./60% RH of films prepared in Example 2 and Comparative Example 2 are plotted with respect to amounts of a conducting agent.

Polyanilinesulfonic acid (available from Mitsubishi Rayon Co., Ltd.) and acrylic resin NIKAZOLE RX-1018 (trade name; available from Nippon Carbide Industries Co., Inc.) capable of forming an emulsion in an aqueous system were dissolved with stirring at room temperature together with 200 parts by weight of water in solid-content compositional ratios shown in FIG. 3, to prepare compositions. Films were formed from the compositions thus obtained, in the same manner as in Example 1. Thus, smooth films each having a layer thickness of about 100 $\mu$m were obtained. Their volume resistivities were measured in the same manner as in Example 1. Results obtained are shown together in FIG. 3.

COMPARATIVE EXAMPLE 1

In Example 1, carbon black FW1 (trade name; available from Degussa Japan Co., Ltd.) was used as a conducting agent in place of the polyanilinesulfonic acid (available from Mitsubishi Rayon Co., Ltd.), and was dissolved with stirring at room temperature together with 1,000 parts by weight of water in solid-content compositional ratios shown in FIG. 2, using glass beads in the same volume as the total volume of these, to prepare compositions. Films were formed from the compositions thus obtained, in the same manner as in Example 1. Thus, smooth films each having a layer thickness of about 100 $\mu$m were obtained. Their volume resistivities were measured in the same manner as in Example 1. Results obtained are shown together in FIG. 2.

COMPARATIVE EXAMPLE 2

In Example 2, carbon black FW1 (trade name; available from Degussa Japan Co., Ltd.) was used as a conducting agent in place of the polyanilinesulfonic acid (available from Mitsubishi Rayon Co., Ltd.), and was dissolved with stirring at room temperature with further addition of 200 parts by weight of water in solid-content compositional ratios shown in FIG. 3, using glass beads in the same manner as in Comparative Example 1, to prepare compositions. Using the compositions thus obtained, smooth films each having a layer thickness of about 100 μm were obtained. Their volume resistivities were measured in the same manner as in Example 1. Results obtained are shown together in FIG. 3.

As can be seen from FIGS. 2 and 3, in the case of water-soluble polyaniline, the electrical resistivity can be controlled with ease by changing its quantity, compared with the case of carbon black.

EXAMPLE 3

Using a composition prepared by adding 10 parts by weight of the polyanilinesulfonic acid as used in Example 1 to 100 parts by weight of the polyvinyl alcohol (PVA) as used in Example 1, a smooth film having a layer thickness of 100 μm was obtained. On this film, electric current was simultaneously observed with a scanning probe microscope (SPI3800N, trade name; manufactured by Seiko Instruments K.K.). An electric-current image thus obtained is shown in FIG. 4.

Figure 4:
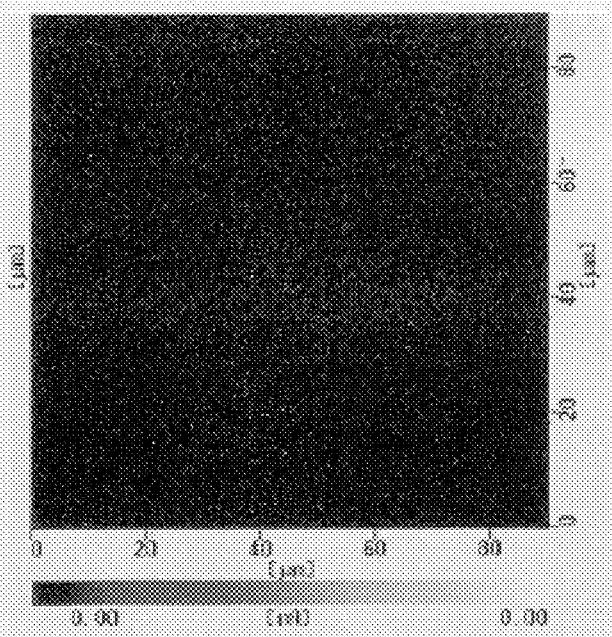
FIG. 4 is a photographic representation of an electric-current image obtained when electric current was simultaneously observed with a scanning probe microscope in Example 3.

In FIG. 4, the ordinate and the abscissa define a scanning area, where electric current flows in a larger quantity at the part the image looks lighter (low-density). Also, the more distinctive the light and shade is, the more uneven the electrical resistivity locally is. The film formed of the PVA mixed with polyanilinesulfonic acid shows no uneven electric-current values in a scanning area of 100 μm around. Since the water-soluble polyaniline has a good dispersibility, the image is uniform.

COMPARATIVE EXAMPLE 3

Using a composition prepared by adding 10 parts by weight of the carbon black as used in Comparative Example 2 to 100 parts by weight of PVA, a smooth film having a layer thickness of 100 μm was obtained. On this film, electric current was simultaneously observed with the scanning probe microscope in the same manner as in Example 3. An electric-current image thus obtained is shown in FIG. 5.

Figure 5:
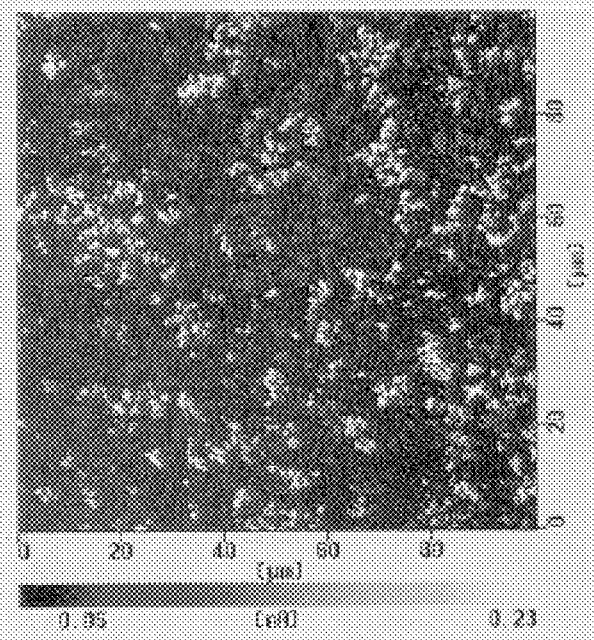
FIG. 5 is a photographic representation of an electric-current image obtained when electric current was simultaneously observed with a scanning probe microscope in Comparative Example 3.

As can be seen from FIG. 5, in the film formed of the PVA mixed with carbon black, grain-shaped spots locally having high electric-current values are observed in a scanning area of 100 μm around, showing uneven conductivity, and the carbon black is not necessarily uniformly dispersed.

As shown in the foregoing, the water-soluble polyaniline causes less position-dependent uneven electrical resistivity of the semiconducting member than the carbon black.

EXAMPLE 4

100 parts by weight of a millable silicone rubber compound SE4637 (trade name; available from Toray Dow Corning K.K.) mixed with about 30% by weight of carbon black as a conducting agent and 1.5 parts by weight of a vulcanizing agent paste RC-450PFD (trade name; available from Toray Dow Corning K.K.) containing a peroxide were kneaded for 10 minutes by means of an open roll mill to prepare a silicone rubber kneaded product with carbon black dispersed uniformly therein. Then, a previously primer-treated mandrel SUM22B of 6 mm in outer diameter, KN-plated in a thickness of 3 to 6 μm, was concentrically inserted to and held in a cylindrical mold of 12 mm in inner diameter. The cavity of this mold was filled with the above rubber kneaded product by injection molding, followed by heating at 170° C. for 3 minutes to carry out vulcanizing molding.

Thus, a roller was formed which was 11.8 mm in outer diameter and had as a conductive rubber layer (thickness: 2.9 mm) a silicone rubber molded product containing carbon black. Making the roller thus obtained serve as a base layer, a surface layer as shown below was formed thereon to produce a charging roller.

Of the PVA coating fluid obtained in Example 1, a coating fluid containing 10 parts by weight of polyanilinesulfonic acid was coated on the periphery of the conductive rubber layer formed previously, which was coated by dip coating at a draw-up rate of 300 mm/minute. After air drying, the coating formed was heated for 30 minutes in a 130° C. oven to effect curing to form on the rubber layer a surface layer of 10 μm in layer thickness.

Figure 6:
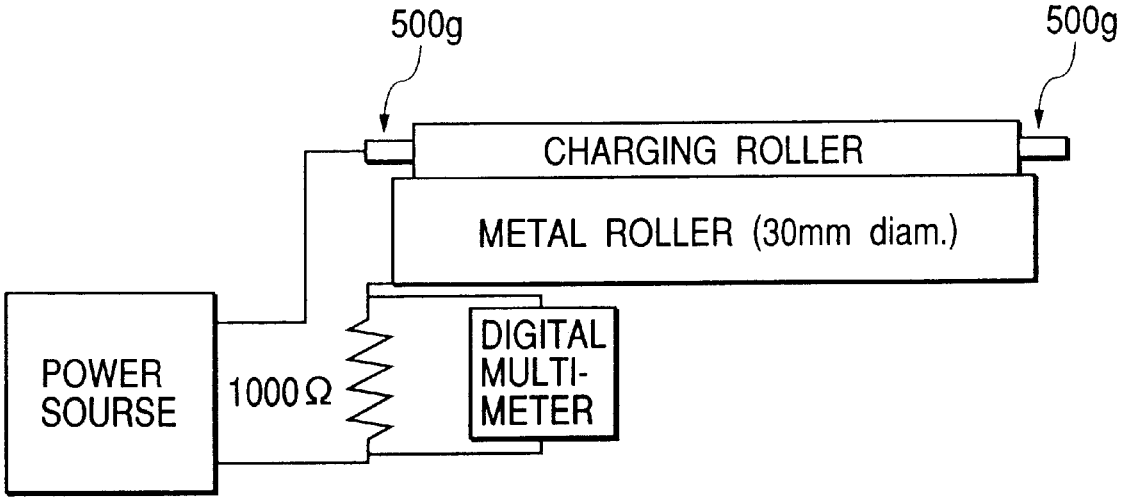
FIG. 6 is a schematic view of an instrument for measuring electric-current values of a charging roller.

The charging roller thus obtained was set on an instrument shown in FIG. 6, with which electric-current values were measured in three environments of LIL (low temperature/low humidity, 15° C./10% RH), N/N (normal temperature/normal humidity, 23° C./60% RH) and H/H (high temperature/high humidity, 32.5° C./80% RH). Voltages applied were an AC voltage of a peak-to-peak potential (Vpp) of 500 V with a frequency of 300 MHz and a DC voltage of 200 V.

The charging roller obtained was also set in a process cartridge used in a laser beam printer (Laser Jet 4000, manufactured by Hewlett-Packard Co.) at the position of its primary charging assembly. Solid-black images, solid-white images and halftone images (in a pattern to print two crossing dots among six dots in total on 2×3 rows) were reproduced in the three environments of LIL, N/N and H/H while superimposingly applying a DC voltage of −620 V at a constant electric current of 550 μA and a frequency of 600 Hz. Images formed were evaluated using a Macbeth densitometer or visually in respect of density, fog, halftone uniformity and any abnormal images due to leak. Also, in the environment of N/N, an A4-size 3,000-sheet image reproduction running test was made, and electric-current values and images were compared with those at the initial stage. Results obtained are shown in Table 1 below together with the layer configuration and electric-current values of the charging roller.

EXAMPLE 5

Using a conductive roller, a charging roller was produced in the same manner as in Example 4 except that the surface layer was replaced with one formed using the acrylic resin type coating fluid obtained in Example 2 and containing 10 parts by weight of polyanilinesulfonic acid. The surface layer was in layer thickness of 10 μm. In the same manner as in Example 4, electric-current values were measured in the three environments of L/L, N/N and H/H and after the running test in the environment of N/N, and solid and halftone images were reproduced in each environment to evaluate image quality. Results obtained are shown in Table 1.

COMPARATIVE EXAMPLE 4

Using a conductive roller, a charging roller was produced in the same manner as in Example 4 except that the surface layer was formed using the PVA type coating fluid used in Comparative Example 1 and containing 8 parts by weight of carbon black. The surface layer was in layer thickness of 10

μm. In the same manner as in Example 4, electric-current values were measured in the three environments of L/L, N/N and H/H and after the running test in the environment of N/N, and solid and halftone images were reproduced in each environment to evaluate image quality. Results obtained are shown in Table 1.

COMPARATIVE EXAMPLE 5

Using a conductive roller, a charging roller was produced in the same manner as in Example 4 except that the surface layer was formed using the acrylic resin type coating fluid used in Comparative Example 2 and containing 8 parts by weight of carbon black. The surface layer was in layer thickness of 10 μm. In the same manner as in Example 4, electric-current values were measured in the three environments of L/L, N/N and H/H and after the running test in the environment of N/N, and solid and halftone images were reproduced in each environment to evaluate image quality. Results obtained are shown in Table 1.

COMPARATIVE EXAMPLE 6

In Example 2, the conducting agent polyanilinesulfonic acid was replaced with lithium perchlorate (available from Kishida Chemical Co., Ltd.) to prepare a composition (solution) containing the conducting agent in an amount of 10 parts by weight based on 100 parts by weight of the acrylic resin binder. A charging roller was produced in the same manner as in Example 4 except for using this solution. The surface layer was in layer thickness of 10 μm. In the same manner as in Example 4, electric-current values were measured in the three environments of L/L, N/N and H/H and after the running test in the environment of N/N, and solid and halftone images were reproduced in each environment to evaluate image quality. Results obtained are shown in Table 1.

In Table 1;

Product Electric-Current Values

Measured by the method shown in FIG. 6.

Letter symbols in image evaluation (solid and halftone images) represent "AA: excellent; A: good; B: a little poor; and C: poor".

(1): Halftone image uniformity (B*: a little low density; B**: a little high density; C*: low density)

(2): Density of solid-black images (values measured with a Macbeth densitometer)

(3): Fog on solid-white images (4): Abnormal images due to leak

EXAMPLE 6

An aqueous 10% solution of polyanilinesulfonic acid (available from Mitsubishi Rayon Co., Ltd.), an aqueous amide resin TORESIN FS-500 (trade name; available from Teikoku Chemical Industry Co., Ltd.) of a self-crosslinking type (cross-linkable functional group: methoxydimethyl group) and a melamine type hydrophilic cross-linking agent SUMITEX RESIN M-3 (trade name; available from Sumitomo Chemical Co., Ltd.) were mixed in a solid-content compositional ratio of 10:100:10 (parts by weight), respectively, and the mixture obtained was stirred at room temperature to prepare a uniform composition.

The composition thus obtained was cast-coated in an aluminum container, followed by preliminary drying at 80° C. to make the solvent evaporate and further followed by heat treatment at 130° C. for 15 minutes in order to make the cross-linking reaction proceed. Thus, a smooth coating film having a layer thickness of about 100 μm was obtained.

The conductivity, its environmental stability and resistance to water (a polyanilinesulfonic acid bleeding test) of the coating film thus obtained were evaluated in the following way. Results obtained are shown in Table 2.

Evaluation I (Conductivity)

The volume resistivity of the above conductive coating film (layer thickness: 100 μm) was measured with a resistance meter HIRESTER (manufactured by Dia Instruments K.K.) in the N/N environment (23° C./60%RH). Applied voltage: 100 V.

Evaluation II (Environmental Stability of Conductivity)

The volume resistivity of the above conductive coating film was measured with a resistance meter HIRESTER (manufactured by Dia Instruments K.K.) in the L/L environment (15° C./10%RH) and the H/H environment (32.5° C./80%RH), and the measured value in the L/L environment was divided by the measured value in the H/H environment. Applied voltage: 100 V.

Evaluation III (Conductivity)

The volume resistivity of the resin binder itself was measured in the N/N environment. Applied voltage: 100 V.

Evaluations IV and V (Water Resistance, Bleeding Test)

The above conductive coating film was visually evaluated after it was immersed in 25° C. water for 12 hours (IV) and after immersed in 80° C. water for 2 hours (V).

Letter symbols in Table 2 represent the following.

AA: No change in the color of water, and no water-soluble polyaniline dissolved out in water at all.

A: Water colored slightly, and the water-soluble polyaniline dissolved out in water in a very small quantity.

B: No change in the color of water for a while after the immersion in water, but the water turned yellow after the lapse of a long time and the water-soluble polyaniline a little dissolved out in water.

C: The water-soluble polyaniline dissolved out greatly, immediately after the immersion in water. The water was dyed in dark brown.

EXAMPLE 7

An aqueous 10% solution of polyanilinesulfonic acid (available from Mitsubishi Rayon Co., Ltd.), an aqueous polymeric compound urethane resin TAKELAC W-635 (trade name; available from Takeda Chemical Industries, Ltd.) and a melamine type cross-linking agent SUMITEX RESIN M-3 (trade name; available from Sumitomo Chemical Co., Ltd.) were mixed in a solid-content compositional ratio of 20:100:10 (parts by weight), respectively, and the mixture obtained was stirred at room temperature to prepare a uniform composition. Using the composition thus obtained, a film was produced in the same manner as in Example 6 to obtain a smooth coating film having a layer thickness of about 100 μm.

The conductivity, its environmental stability and resistance to water of the coating film thus obtained were evaluated in the same manner as in Example 6. Results obtained are shown in Table 2.

EXAMPLE 8

An aqueous 10% solution of polyanilinesulfonic acid (available from Mitsubishi Rayon Co., Ltd.), an aqueous polymeric compound styrene-acrylic resin PRIMAL MC-76 (trade name; available from Rohm and Haas Co.) and an epoxy type cross-linking agent CATALYST #501 (trade name; available from Teikoku Chemical Industry Co., Ltd.) were mixed in a solid-content compositional ratio of 10:100:10 (parts by weight), respectively, and the mixture obtained was stirred at room temperature to prepare a uniform composition. Using the composition thus obtained, a film was produced in the same manner as in Example 6 to obtain a smooth coating film having a layer thickness of about 100 μm.

The conductivity, its environmental stability and resistance to water of the coating film thus obtained were evaluated in the same manner as in Example 6. Results obtained are shown in Table 2.

EXAMPLE 9

Using water as a solvent, a uniform composition of polyanilinesulfonic acid (available from Mitsubishi Rayon Co., Ltd.), an acrylic resin PRIMAL E-358 (trade name; available from Rohm and Haas Co.; an aqueous polymeric compound having a cross-linkable functional group) and a melamine type cross-linking agent SUMITEX RESIN M-3 (trade name; available from Sumitomo Chemical Co., Ltd.) in a solid-content compositional ratio of 10:100:10 (parts by weight), respectively, was prepared in the same manner as in Example 6. Using the composition thus obtained, a film was produced in the same manner as in Example 6 to obtain a smooth coating film having a layer thickness of about 100 μm.

The conductivity, its environmental stability and resistance to water of the coating film thus obtained were evaluated in the same manner as in Example 6. Results obtained are shown in Table 2.

EXAMPLE 10

Using water as a solvent, a uniform composition of polyanilinesulfonic acid (available from Mitsubishi Rayon Co., Ltd.), an acrylic resin NIKAZOLE FX-561A (trade name; available from Nippon Carbide Industries Co., Inc.; an aqueous polymeric compound having a cross-linkable functional group) and an epoxy type cross-linking agent CATALYST #50 (trade name; available from Teikoku Chemical Industry Co., Ltd.) in a solid-content compositional ratio of 10:100:10 (parts by weight), respectively, was prepared in the same manner as in Example 6. Incidentally, in order to prevent the polyanilinesulfonic acid used here from agglomerating because of any pH shock occurring when it was added in the emulsion, an aqueous 10% solution of polyanilinesulfonic acid was adjusted to have a pH around 6.5 to 7.5, the same pH as that of the acrylic resin, with 28% ammonia water. Using the composition thus obtained, a film was produced in the same manner as in Example 6 to obtain a smooth coating film having a layer thickness of about 100 μm.

The conductivity, its environmental stability and resistance to water of the coating film thus obtained were evaluated in the same manner as in Example 6. Results obtained are shown in Table 2.

EXAMPLES 11 AND 12

Uniform compositions were prepared by mixing materials in the same manner as in Examples 7 and 8, respectively, except that the amount of the polyanilinesulfonic acid was changed to 30 parts by weight. Using the compositions thus obtained, films were produced in the same manner as in Example 6 to obtain smooth coating films each having a layer thickness of about 100 μm.

The conductivity, its environmental stability and resistance to water of the coating films thus obtained were evaluated in the same manner as in Example 6. Results obtained are shown in Table 2.

EXAMPLES 13 TO 17

Compositions were prepared by mixing materials in the same manner as in Examples 6 to 10, respectively, except that any cross-linking agent was not added. Using the compositions thus obtained, films were produced in the same manner as in Example 6 to obtain smooth coating films each having a layer thickness of about 100 μm.

The conductivity, its environmental stability and resistance to water of the coating films thus obtained were evaluated in the same manner as in Example 6. Results obtained are shown in Table 2.

As shown in the foregoing, in the present invention, the addition of the cross-linking agent brings about a more improved effect of preventing the bleeding and also has made it possible to provide good-conductivity coating films more improved in the environmental stability of conductivity, than the case where the cross-linking agent is not added. Also, in the semiconducting member of the present invention, the case where as shown in Examples 11 and 12 the aqueous polymeric compound having a cross-linkable functional group is used as a resin binder in the aqueous polymeric compound is preferred to the case where the one having no cross-linkable functional group is used, because more dense cross-linking takes place between the aqueous polymeric compound and the cross-linking agent and coating films are obtainable which have a superior effect of preventing the bleeding even under severe conditions such that the water-soluble go polyaniline is present in the coating films in a large quantity.

EXAMPLE 18

Into 100 parts by weight of NIPOL 1042 (trade name; available from Nippon Zeon Co.), 5 parts by weight of zinc oxide, 1 part by weight of stearic acid, 30 parts by weight of carbon black, 3 parts by weight of a vulcanization accelerator and 1 part by weight of sulfur were kneaded for 10 minutes by means of an open roll mill to obtain an NBR rubber composition. This rubber composition was extruded into a tube by means of an extruder, followed by vulcanization at 160° C. for 30 minutes in a vulcanizer to obtain a vulcanized rubber tube. To this vulcanized rubber tube, a conductive shaft (mandrel) of 6 mm in outer diameter was inserted, followed by abrasion so as to provide an outer diameter of 11.8 mm to form a roller. Making the roller thus obtained serve as a base layer (the roller having as a conductive rubber layer the NBR rubber molded product containing carbon black), a surface layer as shown below was formed thereon to produce a charging roller.

The aqueous amide type coating fluid obtained in Example 6 was coated on the periphery of the conductive rubber layer formed previously, which was coated by dip coating at a draw-up rate of 300 mm/minute. After air drying, the coating formed was heated for 30 minutes in a 130° C. oven to effect curing to form on the rubber layer a surface layer of 10 μm in layer thickness.

The charging roller thus obtained was set on an instrument shown in FIG. 6, with which electric-current values were measured in three environments of L/L (low temperature/low humidity, 15° C./10% RH), N/N (normal temperature/normal humidity, 23° C./60% RH) and H/H (high temperature/high humidity, 32.5° C./80% RH). Voltages applied were an AC voltage of a Vpp of 500 V with a frequency of 300 MHz and a DC voltage of 200 V.

The charging roller obtained was also set in a process cartridge used in a laser beam printer (Laser Jet 4000, manufactured by Hewlett-Packard Co.) at the position of its primary charging assembly. Solid-black images, solid-white images and halftone images (in a pattern to print two crossing dots among six dots in total on 2×3 rows) were reproduced in the three environments of L/L, N/N and H/H and after an A4-size 3,000-sheet image reproduction running test in the environment of N/N while superimposingly applying a DC voltage of −620 V at a constant electric current of 550 uA and a frequency of 600 Hz. Images formed were evaluated in respect of density, fog, halftone uniformity and any abnormal images due to leak. Also, electric-current values of the charging roller after the running test were again measured with the instrument shown in FIG. 6.

The process cartridge provided with this charging roller was left for 30 days in the environment of H/H to make visual observation on any contamination of the photosensitive drum (a drum contamination test), and thereafter the roller electric-current values and images in the environment of N/N were compared with those at the initial stage.

Results obtained are shown in Tables 3 and 4 below together with the layer configuration, surface layer volume resistivity and roller electric-current values of the charging roller.

EXAMPLES 19 TO 21

Using conductive rollers, charging rollers were produced in the same manner as in Example 18 except that the surface layer coating fluid was replaced with the compositions obtained in Examples 7, 13 and 14, respectively; provided that, with regard to Examples 19 and 21 using the aqueous urethane resin as a binder, used were those in which the amount of the conducting agent was made larger to 20 parts by weight to control volume resistivities to $3\times10^9$ Ω·cm and $1\times10^9$ Ω·cm, respectively, in order to more improve the conductivity of the compositions of Examples 7 and 14. The charging rollers thus produced were tested in the same manner as in Example 18 to measure electric-current values in the three environments of L/L, N/N and H/H and after the running test in the environment of N/N, and to reproduce solid images and halftone images to evaluate image quality. The drum contamination test in the environment of H/H was also made and thereafter the roller electric-current values and images in the environment of N/N were compared with those at the initial stage.

Results obtained are shown in Tables 3 and 4.

In Table 4;

letter symbols in image evaluation (solid and halftone images) represent "A: good; B: a little poor; and C: poor".

Volume Resistivity

Measured with HIRESTER (manufactured by Dia Instruments K.K.) in the environment of N/N.

Product Electric-current Values

Measured by the method shown in FIG. 6.

(1): Halftone image uniformity (C*: low density)

(2): Density of solid-black images (values measured with a Macbeth reflect densitometer)

(3): Fog on solid-white images (4): Abnormal images due to leak (5): Drum contamination test (The process cartridge provided with the charging roller was left for 30 days in the environment of H/H, and visual observation was made on any contamination of the photosensitive drum surface. A: No contamination. B: Contaminated.)

EXAMPLES 22 TO 27

Using conductive rollers, charging rollers were produced in the same manner as in Example 18 except that the surface layer coating fluid was replaced with the compositions obtained in Examples 8 to 10 and 15 to 17, respectively. Evaluation was made on all of these in the same manner as in the above Examples. As the result, in Examples 22 to 24, no drum contamination occurred like the results of Examples 18 and 19 shown in Table 4 and high-grade and stable images were obtained in every environment. On the other hand, in Examples 25 to 27, drum contamination occurred like the results of Examples 20 and 21 shown in Table 4, to cause abnormal images due to faulty charging.

As shown in the foregoing, in the present invention, the use of the cross-linking agent enables formation of coating films which little cause the bleeding of the water-soluble polyaniline from the interior of the present semiconducting member, have superior resistance to water and have a good conductivity. Also, in the semiconducting member of the present invention, semiconducting members having much superior environmental stability of conductivity can be provided, compared with the case where the cross-linking agent is not used.

The functional member for electrophotography that employs the semiconducting member of the present invention can also provide high-grade and stable images in every environment because, compared with the case where the cross-linking agent is not used, it does not cause any photosensitive drum contamination due to bleeding even in the environment of high temperature and high humidity and has a superior environmental stability of conductivity. Also, the functional member for electrophotography that employs the present semiconducting member can provide very good images free of uneven density for both solid and halftone images.

On the other hand, the functional member for electrophotography that employs the semiconducting member containing no cross-linking agent has not necessarily a sufficient effect of preventing the bleeding, and hence cause faulty images due to photosensitive drum contamination caused by bleeding components.

EXAMPLE 28

An aqueous 10% solution of polyanilinesulfonic acid (available from Mitsubishi Rayon Co., Ltd.), an aqueous polymeric compound amide resin TORESIN FS-500 (trade name; available from Teikoku Chemical Industry Co., Ltd.) of a self-crosslinking type (cross-linkable functional group: methoxymethyl group), a melamine type hydrophilic cross-linking agent SUMITEX RESIN M-3 (trade name; available from Sumitomo Chemical Co., Ltd.) and surface-oxidized carbon black CW-1 (trade name; available from Orient Chemical Industries Ltd.) as hydrophilic powder were mixed in a solid-content compositional ratio of 10:100:10:10 (parts by weight), respectively, and the mixture obtained was stirred at room temperature to prepare a uniform composition.

The composition thus obtained was cast-coated in an aluminum container, followed by preliminary drying at 80° C. to make the solvent evaporate and further followed by heat treatment at 130° C. for 15 minutes in order to make the cross-linking reaction proceed. Thus, a smooth coating film having a layer thickness of about 100 μm was obtained.

The conductivity, its environmental stability and resistance to water (a polyanilinesulfonic acid bleeding test) of the coating film thus obtained were evaluated in the following way. Results obtained are shown in Table 5.

Evaluation I (Conductivity)

The volume resistivity of the above conductive coating film (layer thickness: 100 μm) was measured with a resistance meter HIRESTER (manufactured by Dia Instruments K.K.) in the N/N environment (23° C./60%RH). Applied voltage: 100 V.

Evaluation II (Environmental Stability of Conductivity)

The volume resistivity of the above conductive coating film was measured with a resistance meter HIRESTER (manufactured by Dia Instruments K.K.) in the L/L environment (15° C./10%RH) and the H/H environment (32.5° C./80%RH), and the measured value in the L/L environment was divided by the measured value in the H/H environment. Applied voltage: 100 V.

Evaluation III (Conductivity)

The volume resistivity of the resin binder itself was measured in the N/N environment. Applied voltage: 100 V.

Evaluations IV and V (Water Resistance, Bleeding Test):

The above conductive coating film was visually evaluated after it was immersed in 25° C. water for 12 hours (IV) and after immersed in 80° C. water for 2 hours (V).

Letter symbols in Table 5 represent the following.

AA: No change in the color of water, and no water-soluble polyaniline dissolved out in water at all.

A: Water colored slightly, and the water-soluble polyaniline dissolved out in water in a very small quantity.

B: No change in the color of water for a while after the immersion in water, but the water turned yellow after the lapse of a long time and the water-soluble polyaniline a little dissolved out in water.

C: The water-soluble polyaniline dissolved out greatly, immediately after the immersion in water. The water was dyed in dark brown.

EXAMPLE 29

An aqueous 10% solution of polyanilinesulfonic acid (available from Mitsubishi Rayon Co., Ltd.), an aqueous polymeric compound urethane resin TAKELAC W-635 (trade name; available from Takeda Chemical Industries, Ltd.) and surface-oxidized carbon black CW-1 (trade name; available from Orient Chemical Industries Ltd.) as hydrophilic powder were mixed in a solid-content compositional ratio of 10:100:10 (parts by weight), respectively, and the mixture obtained was stirred at room temperature to prepare a uniform composition. Using the composition thus obtained, a film was produced in the same manner as in Example 28 to obtain a smooth coating film having a layer thickness of about 100 μm.

The conductivity, its environmental stability and resistance to water of the coating film thus obtained were evaluated in the same manner as in Example 28. Results obtained are shown in Table 5.

EXAMPLE 30

Using water as a solvent, a uniform composition of polyanilinesulfonic acid (available from Mitsubishi Rayon Co., Ltd.), an acrylic resin PRIMAL E-358 (trade name; available from Rohm and Haas Co.; an aqueous polymeric compound having a cross-linkable functional group), a melamine type cross-linking agent SUMITEX RESIN M-3 (trade name; available from Sumitomo Chemical Co., Ltd.) and carbon black FW1 (trade name; available from Degussa Japan Co., Ltd.) as hydrophilic powder in a solid-content compositional ratio of 10:100:10:30 (parts by weight), respectively, was prepared in the same manner as in Example 28. Using the composition thus obtained, a film was produced in the same manner as in Example 28 to obtain a smooth coating film having a layer thickness of about 100 μm.

The conductivity, its environmental stability and resistance to water of the coating film thus obtained were evaluated in the same manner as in Example 28. Results obtained are shown in Table 5.

EXAMPLE 31

Using water as a solvent, a uniform composition of polyanilinesulfonic acid (available from Mitsubishi Rayon Co., Ltd.), a aqueous polymeric compound styrene-acrylic resin PRIMAL MC-76 (trade name; available from Rohm and Haas Co.) and carbon black FW1 (trade name; available from Degussa Japan Co., Ltd.) as hydrophilic powder in a solid-content compositional ratio of 10:100:30 (parts by weight), respectively, was prepared in the same manner as in Example 28. Using the composition thus obtained, a film was produced in the same manner as in Example 28 to obtain a smooth coating film having a layer thickness of about 100 μm.

The conductivity, its environmental stability and resistance to water of the coating film thus obtained were evaluated in the same manner as in Example 28. Results obtained are shown in Table 5.

EXAMPLES 32 TO 35

Compositions were prepared by mixing materials in the same manner as in Examples 28 to 31, respectively, except that any hydrophilic powder was not added. Using the compositions thus obtained, films were produced in the same manner as in Example 28 to obtain smooth coating films each having a layer thickness of about 100 μm.

The conductivity, its environmental stability and resistance to water of the coating films thus obtained were evaluated in the same manner as in Example 28. Results obtained are shown in Table 5.

In Table 5, letter symbols in image evaluation (solid and halftone images) represent "AA: excellent; A: good; B: a little poor; and C: poor".

As shown in Table 5, the water-soluble polyaniline used in the surface layer of the charging roller provides very good images free of uneven density for both solid and halftone images, and also provides high-grade and stable images during running, compared with the carbon black. Also, the coating film obtained by adding the water-soluble polyaniline in the resin binder has an advantage that the semi-conducting member is less affected by any environmental variations caused by the addition of the conducting agent, compared with ionic conducting agents such as lithium perchlorate. Thus, it can provide superior electrophotographic images in every environment.

As shown in the foregoing, in the present invention, the addition of the hydrophilic powder has made it possible to provide good-conductivity coating films more improved in the environmental stability of conductivity than the case where the hydrophilic powder is not added. Also, the addition of the cross-linking agent has made it possible to provide good-conductivity coating films more improved in the effect of preventing the bleeding.

EXAMPLE 36

Into 100 parts by weight of NIPOL 1042 (trade name; available from Nippon Zeon Co.), 5 parts by weight of zinc oxide, 1 part by weight of stearic acid, 30 parts by weight of carbon black, 3 parts by weight of a vulcanization accelerator and 1 part by weight of sulfur were kneaded for 10 minutes by means of an open roll mill to obtain an NBR rubber composition. This rubber composition was extruded into a tube by means of an extruder, followed by vulcanization at 160° C. for 30 minutes in a vulcanizer to obtain a vulcanized rubber tube. To this vulcanized rubber tube, a conductive shaft (mandrel) of 6 mm in outer diameter was inserted, followed by abrasion so as to provide an outer diameter of 11.8 mm to form a roller. Making the roller thus obtained serve as a base layer (the roller having as a conductive rubber layer the NBR rubber molded product containing carbon black), a surface layer as shown below was formed thereon to produce a charging roller.

The aqueous amide type coating fluid obtained in Example 28 was coated on the periphery of the conductive rubber layer formed previously, which was coated by dip coating at a draw-up rate of 300 mm/minute. After air drying, the coating formed was heated for 30 minutes in a 130° C. oven to effect curing to form on the rubber layer a surface layer of 10 $\mu$m in layer thickness.

The charging roller thus obtained was set on an instrument shown in FIG. 6, with which electric-current values were measured in three environments of L/L (low temperature/low humidity, 15° C./10% RH), N/N (normal temperature/normal humidity, 23° C./60% RH) and H/H (high temperature/high humidity, 32.5° C./80% RH). Voltages applied were an AC voltage of a Vpp of 500 V with a frequency of 300 MHz and a DC voltage of 200 V.

The charging roller obtained was also set in a process cartridge used in a laser beam printer (Laser Jet 4000, manufactured by Hewlett-Packard Co.) at the position of its primary charging assembly. Solid-black images, solid-white images and halftone images (in a pattern to print two crossing dots among six dots in total on 2×3 rows) were reproduced in the three environments of L/L, N/N and H/H and after a running test in the environment of N/N while superimposingly applying a DC voltage of −620 V at a constant electric current of 550 $\mu$A and a frequency of 600 Hz. Images formed were evaluated in respect of density, fog, halftone uniformity and any abnormal images due to leak. Also, electric-current values of the charging roller after the running test were again measured with the instrument shown in FIG. 6.

The process cartridge provided with this charging roller was left for 30 days in the environment of H/H to make visual observation on any contamination of the photosensitive drum (a drum contamination test), and thereafter the roller electric-current values and images in the environment of N/N were compared with those at the initial stage.

Results obtained are shown in Table 6 below together with the layer configuration, surface layer volume resistivity and roller electric-current values of the charging roller.

EXAMPLES 37 TO 39

Using conductive rollers, charging rollers were produced in the same manner as in Example 36 except that the surface layer coating fluid was replaced with the compositions obtained in Examples 29, 32 and 33, respectively; provided that, with regard to Examples 37 and 39 using the aqueous urethane resin as a binder, used were those in which the amount of the conducting agent was made larger to 20 parts by weight to control volume resistivities to $2.9\times10^9\Omega\cdot$cm and $1.1\times10^9$ $\Omega\cdot$cm, respectively, in order to more improve the conductivity of the compositions of Examples 28 and 33. The charging rollers thus produced were tested in the same manner as in Example 36 to measure electric-current values in the three environments of L/L, N/N and H/H and after an A4-size 3,000-sheet image reproduction running test in the environment of N/N, and to reproduce solid images and halftone images to evaluate image quality. The drum contamination test in the environment of H/H was also made and thereafter the roller electric-current values and images in the environment of N/N were compared with those at the initial stage.

Results obtained are shown in Table 6.

In Table 6;

Volume Resistivity

Measured with HIRESTER (manufactured by Dia Instruments K.K.) in the environment of N/N.

Product Electric-current Values

Measured by the method shown in FIG. 6.

Letter symbols in image evaluation (solid and halftone images) represent "A: good; B: a little poor; and C: poor".

(1): Halftone image uniformity (C*: low density)

(2): Density of solid-black images (values measured with a Macbeth reflect densitometer)

(3): Fog on solid-white images (4): Abnormal images due to leak (5): Drum contamination test (The process cartridge provided with the charging roller was left for 30 days in the environment of H/H, and visual observation was made on any contamination of the photosensitive drum surface. A: No contamination. B: Contaminated.)

EXAMPLES 40 TO 43

Using conductive rollers, charging rollers were produced in the same manner as in Example 36 except that the surface layer coating fluid was replaced with the compositions obtained in Examples 30, 31, 34 and 35, respectively. Evaluation was made on all of these in the same manner as in the above Examples. As the result, in Examples 40 and 41, no drum contamination occurred like the results of Examples 36 and 37 shown in Table 6 and high-grade and stable images were obtained in every environment. On the other hand, in Examples 42 and 43, drum contamination occurred like the results of Example 39 shown in Table 6, to cause abnormal images due to faulty charging.

EXAMPLES 44 AND 45

Into 100 parts by weight of EPICHLOMER CG102 (trade name; available from Daiso Trading Co., Ltd.), 5 parts by weight of zinc oxide, 1 part by weight of stearic acid, 30 parts by weight of calcium carbonate, 3 parts by weight of a vulcanization accelerator and 1 part by weight of sulfur were kneaded for 10 minutes by means of an open roll mill to obtain an epichlorohydrin rubber composition. This rubber composition was extruded into a tube by means of an extruder, followed by vulcanization at 160° C. for 30 minutes in a vulcanizer to obtain a vulcanized rubber tube. To this vulcanized rubber tube, a conductive shaft (mandrel) of 6 mm in outer diameter was inserted, followed by abrasion so as to provide an outer diameter of 11.8 mm to form a roller. Making the roller serve as a base layer (the roller having as a conductive rubber layer the epichlorohydrin rubber molded product), surface layers as shown below were each formed thereon to produce a charging roller.

As surface layer coating fluids, the compositions obtained in Examples 28 and 32 were respectively used to produce charging rollers.

The charging rollers thus produced were tested in the same manner as in Example 36 to measure electric-current values in the three environments of L/L, N/N and H/H and after the running test in the environment of N/N, and to reproduce solid images and halftone images to evaluate image quality. The drum contamination test in the environment of H/H was also made and thereafter the roller electric-current values and images in the environment of N/N were compared with those at the initial stage.

Results obtained are shown in Table 7.

EXAMPLES 46 AND 47

100 parts by weight of a millable silicone rubber compound SE4637 (trade name; available from Toray Dow Corning K.K.) mixed with about 30% by weight of carbon black as a conducting agent and 1.5 parts by weight of a vulcanizing agent paste RC-45OPFD (trade name; available from Toray Dow Corning K.K.) containing a peroxide were kneaded for 10 minutes by means of an open roll mill to prepare a silicone rubber kneaded product with carbon black dispersed uniformly therein. Then, a previously primer-treated mandrel SUM22B of 6 mm in outer diameter, KN-plated in a thickness of 3 to 6 μm, was concentrically inserted to and held in a cylindrical mold of 12 mm in inner diameter. The cavity of this mold was filled with the above rubber kneaded product by injection molding, followed by heating at 170° C. for 3 minutes to carry out vulcanizing molding.

Thus, a roller was formed which was 11.8 mm in outer diameter and had as a conductive rubber layer (thickness: 2.9 mm) a silicone rubber molded product containing carbon black. Making the roller thus obtained serve as a base layer, surface layers as shown below were each formed thereon to produce a charging roller.

As surface layer coating fluids, the compositions obtained in Examples 28 and 32 were respectively used to produce charging rollers.

The charging rollers thus produced were tested in the same manner as in Example 36 to measure electric-current values in the three environments of L/L, N/N and H/H and after the running test in the environment of N/N, and to reproduce solid images and halftone images to evaluate image quality. The drum contamination test in the environment of H/H was also made and thereafter the roller electric-current values and images in the environment of N/N were compared with those at the initial stage.

Results obtained are shown in Table 7.

In Table 7;

Volume Resistivity

Measured with HIRESTER (manufactured by Dia Instruments K.K.) in the environment of N/N. Product electric-current values:

Measured by the method shown in FIG. 6.

Letter symbols in image evaluation (solid and halftone images) represent "A: good; B: a little poor; and C: poor".

(1): Halftone image uniformity (C*: low density)

(2): Density of solid-black images (values measured with a Macbeth reflect densitometer)

(3): Fog on solid-white images (4): Abnormal images due to leak (5): Drum contamination test (The process cartridge provided with the charging roller was left for 30 days in the environment of H/H, and visual observation was made on any contamination of the photosensitive drum surface. A: No contamination. B: Contaminated.)

As shown in the foregoing, in the present invention, the addition of the hydrophilic powder has made it possible to provide a semiconducting member having a better environmental stability of conductivity than the case where the hydrophilic powder is not used. Also, the use of the cross-linking agent has made it possible to provide good-conductivity coating films which do not cause the bleeding of the water-soluble polyaniline from the interior of the present semiconducting member, have superior resistance to water and have a good conductivity.

The functional member for electrophotography that employs the semiconducting member of the present invention also has small variations of product electric-current values in every environment, so that it can provide images which are high-grade and stable in solid-black density in every environment. Also, the use of the cross-linking agent does not cause the photosensitive drum contamination due to bleeding even in the environment of high temperature and high humidity and can provide images under superior environmental stability. Also, because of the use of the NBR rubber or hydrin rubber in the elastic layer, good images can be obtained. Still also, the functional member for electrophotography that employs the present semiconducting member of the invention can provide very good images free of uneven density for both solid and halftone images.

On the other hand, the functional member for electrophotography that employs the semiconducting member containing no hydrophilic powder has not necessarily a sufficient environment stability of conductivity, and hence can not provide any high-grade stable images.

The semiconducting member of the present invention is applicable to not only charging rollers as shown in Examples, but also other functional members for electrophotography, i.e., developing rollers, transfer rollers and so forth.

TABLE 1

| Layer configuration | | | | Evaluation items | | | | | |
|---|---|---|---|---|---|---|---|---|---|
| | | | | Product electric = current values | | Image reproduction | | | |
| Elastic layer | Surface layer | Surface layer conducting agent | Conditions | AC (μA) | DC (μA) | (1) | (2) | (3) | (4) |
| Example 4: | | | | | | | | | |
| Silicone rubber | PVA | Polyaniline-sulfonic acid | L/L initial | 232 | 156 | AA | 1.51 | A | A |
| | | | N/N initial | 297 | 215 | AA | 1.46 | A | A |
| | | | H/H initial | 400 | 320 | AA | 1.42 | A | A |
| | | | After N/N run. | 304 | 220 | AA | 1.43 | A | A |

TABLE 1-continued

| Layer configuration | | | | Evaluation items | | | | | |
|---|---|---|---|---|---|---|---|---|---|
| | | | | Product electric = current values | | | | | |
| Elastic layer | Surface layer | Surface layer conducting agent | Conditions | AC (μA) | DC (μA) | Image reproduction (1) | (2) | (3) | (4) |
| Comparative Example 4: | | | | | | | | | |
| Silicone rubber | PVA | Carbon black | L/L initial | 240 | 148 | A | 1.50 | A | A |
| | | | N/N initial | 290 | 200 | A | 1.47 | A | A |
| | | | H/H initial | 415 | 317 | A | 1.40 | A | A |
| | | | After N/N run. | 120 | 10 | B* | 1.30 | B | A |
| Example 5: | | | | | | | | | |
| Silicone rubber | Acrylic resin | Polyaniline-sulfonic acid | L/L initial | 286 | 150 | AA | 1.50 | A | A |
| | | | N/N initial | 300 | 170 | AA | 1.45 | A | A |
| | | | H/H initial | 334 | 182 | AA | 1.44 | A | A |
| | | | After N/N run. | 311 | 176 | AA | 1.42 | A | A |
| Comparative Example 5: | | | | | | | | | |
| Silicone rubber | Acrylic resin | Carbon black | L/L initial | 269 | 160 | A | 1.49 | A | A |
| | | | N/N initial | 280 | 190 | A | 1.46 | A | A |
| | | | H/H initial | 315 | 208 | A | 1.44 | A | A |
| | | | After N/N run. | 130 | 15 | B* | 1.31 | B | A |
| Comparative Example 6: | | | | | | | | | |
| Silicone rubber | Acrylic resin | Lithium perchlorate | L/L initial | 104 | 24 | B** | 1.54 | B | B |
| | | | N/N initial | 315 | 139 | AA | 1.47 | A | A |
| | | | H/H initial | 2,500 | 1,953 | C* | 1.20 | A | C |
| | | | After N/N run. | 324 | 150 | AA | 1.36 | B | B |

TABLE 2

| Conducting agent, water = soluble polyaniline | | | | Cross-linkable | | Evaluation | | | | |
|---|---|---|---|---|---|---|---|---|---|---|
| | | | | | | | | | Water resistance (bleeding test) | |
| Example | pbw | pH = adjusted to: * | Type of resin for binder (100 parts) | functional group in binder | Type of cross-linking agent | I (Ω · cm) | II | III (Ω · cm) | IV | V |
| 6 | 10 | no | Aqueous amide | yes | Melamine | $2.5 \times 10^{9}$ | 32 | $1.0 \times 10^{11}$ | AA | AA |
| 7 | 10 | no | Aqueous urethane | no | Melamine | $3.5 \times 10^{11}$ | 126 | $1.7 \times 10^{14}$ | AA | AA |
| 8 | 10 | no | Aqueous styrene = acrylic | no | Epoxy | $3.5 \times 10^{7}$ | 79 | $1.0 \times 10^{11}$ | AA | AA |
| 9 | 10 | no | Aqueous acrylic | yes | Melamine | $1.0 \times 10^{8}$ | 63 | $1.0 \times 10^{11}$ | AA | AA |
| 10 | 10 | 6.5–7.5 | Aqueous acrylic | yes | Epoxy | $1.8 \times 10^{8}$ | 32 | $3.0 \times 10^{11}$ | AA | AA |
| 11 | 30 | no | Aqueous urethane | no | Melamine | $4.0 \times 10^{8}$ | 89 | $1.7 \times 10^{11}$ | AA | A |
| 12 | 30 | no | Aqueous acrylic | yes | Melamine | $1.0 \times 10^{8}$ | 13 | $1.0 \times 10^{11}$ | AA | AA |
| 13 | 10 | no | Water-soluble amide | yes | no | $1.6 \times 10^{9}$ | 316 | $1.0 \times 10^{11}$ | A | B |
| 14 | 10 | no | Aqueous urethane | no | no | $3.0 \times 10^{11}$ | 3,162 | $1.7 \times 10^{14}$ | C | C |
| 15 | 10 | no | Aqueous styrene = acrylic | no | no | $1.0 \times 10^{7}$ | 3,162 | $1.0 \times 10^{11}$ | C | C |
| 16 | 10 | no | Aqueous acrylic | yes | no | $2.0 \times 10^{7}$ | 794 | $1.0 \times 10^{11}$ | A | B |
| 17 | 10 | 6.5–7.5 | Aqueous acrylic | yes | no | $5.0 \times 10^{7}$ | 1,259 | $3.0 \times 10^{11}$ | C | C |

*with ammonia

TABLE 3

| Example | Elastic layer | Layer configuration: Surface layer: Binder | Cross = linkable functional group in binder | Amount of conducting agent, water-soluble polyaniline (pbw) | Cross = linking agent | Volume resistivity |
|---|---|---|---|---|---|---|
| 18 | NBR rubber | Aqueous amide resin | yes | 10 | Melamine type | $2.5 \times 10^9$ |
| 19 | NBR rubber | Aqueous urethane resin | no | 20 | Melamine type | $3.0 \times 10^9$ |
| 20 | NBR rubber | Aqueous amide resin | yes | 10 | no | $1.6 \times 10^9$ |
| 21 | NBR rubber | Aqueous urethane resin | no | 20 | no | $1.0 \times 10^9$ |

TABLE 4

| Conditions | Product electric = current values: AC (μA) | DC (μA) | Evaluation (1) | (2) | (3) | (4) | Drum contamination test (5) |
|---|---|---|---|---|---|---|---|
| Example 18: | | | | | | | |
| L/L initial | 230 | 155 | A | 1.51 | A | A | |
| N/N initial | 295 | 211 | A | 1.49 | A | A | |
| H/H initial | 330 | 237 | A | 1.48 | A | A | A |
| After N/N running | 304 | 220 | A | 1.43 | A | A | |
| After drum contamination test (N/N) | 304 | 220 | A | 1.49 | A | A | |
| Example 19: | | | | | | | |
| L/L initial | 240 | 160 | A | 1.50 | A | A | |
| N/N initial | 312 | 243 | A | 1.49 | A | A | |
| H/H initial | 366 | 280 | A | 1.47 | A | A | A |
| After N/N running | 300 | 239 | A | 1.42 | A | A | |
| After drum contamination test (N/N) | 340 | 252 | A | 1.48 | A | A | |
| Example 20: | | | | | | | |
| L/L initial | 263 | 199 | A | 1.50 | A | A | |
| N/N initial | 330 | 228 | A | 1.48 | A | A | |
| H/H initial | 500 | 395 | A | 1.43 | A | A | C |
| After N/N running | 289 | 220 | A | 1.41 | A | A | |
| After drum contamination test (N/N) | 1,500 | 1,110 | C* | 1.32 | A | C | |
| Example 21: | | | | | | | |
| L/L initial | 302 | 244 | A | 1.49 | A | A | |
| N/N initial | 354 | 270 | A | 1.48 | A | A | |
| H/H initial | 646 | 479 | A | 1.39 | A | A | C |
| After N/N running | 327 | 234 | A | 1.41 | A | A | |
| After drum contamination test (N/N) | 2,480 | 1,742 | C* | 1.20 | A | C | |

TABLE 5

| Example | Amount of conducting agent, water-soluble polyaniline (pbw) | Type of binder (100 pbw) | Cross-linking agent | Hydrophilic powder/(pbw) | Evaluation: I (Ω · cm) | II | III (Ω · cm) | Water resistance (bleeding test): IV | V |
|---|---|---|---|---|---|---|---|---|---|
| 28 | 10 | Aqueous amide resin | Melamine type | CW-1/(10) | $2.3 \times 10^9$ | 2.5 | $1.0 \times 10^{11}$ | AA | AA |
| 29 | 10 | Aqueous urethane resin | no | CW-1/(10) | $3.4 \times 10^{11}$ | 7.9 | $1.7 \times 10^{14}$ | B | C |

TABLE 5-continued

| Example | Amount of conducting agent, water-soluble polyaniline (pbw) | Type of binder (100 pbw) | Cross-linking agent | Hydrophilic powder/(pbw) | Evaluation I (Ω · cm) | II | III (Ω · cm) | Water resistance (bleeding test) IV | V |
|---|---|---|---|---|---|---|---|---|---|
| 30 | 10 | Aqueous acrylic resin | Melamine type | FW1/(30) | $3.6 \times 10^{7}$ | 3.2 | $1.0 \times 10^{11}$ | AA | AA |
| 31 | 10 | Aqueous styrene = acrylic resin | no | FW1/(30) | $2.2 \times 10^{7}$ | 7.9 | $1.0 \times 10^{11}$ | B | C |
| 32 | 10 | Aqueous amide resin | Melamine type | no | $2.5 \times 10^{9}$ | 100.0 | $1.0 \times 10^{11}$ | AA | A |
| 33 | 10 | Aqueous urethane resin | no | no | $3.0 \times 10^{11}$ | 3,162.3 | $1.7 \times 10^{14}$ | C | C |
| 34 | 10 | Aqueous acrylic resin | Melamine type | no | $1.0 \times 10^{7}$ | 125.9 | $1.0 \times 10^{11}$ | AA | A |
| 35 | 10 | Aqueous styrene = acrylic resin | no | no | $2.1 \times 10^{7}$ | 1,000.0 | $1.0 \times 10^{11}$ | C | C |

TABLE 6

| Layer configuration: Elastic layer | Surface layer: Binder | Cross = linking agent | Hydrophilic powder | Volume resistivity (Ω · cm) | Conditions | Evaluation items: Product electric = current values AC (μA) | DC (μA) | Image reproduction (1) | (2) | (3) | (4) | DCT* (5) |
|---|---|---|---|---|---|---|---|---|---|---|---|---|
| Example 36: | | | | | | | | | | | | |
| NBR rubber | Aqueous amide resin | Melamine type | CW-1 | $2.3 \times 10^{9}$ | L/L initial | 230 | 155 | AA | 1.51 | A | A | |
| | | | | | N/N initial | 232 | 157 | AA | 1.49 | A | A | |
| | | | | | H/H initial | 237 | 161 | AA | 1.48 | A | A | A |
| | | | | | After N/N run. | 233 | 157 | AA | 1.43 | A | A | |
| | | | | | After DCT* (N/N) | 234 | 158 | AA | 1.49 | A | A | |
| Example 37: | | | | | | | | | | | | |
| NBR rubber | Aqueous urethane resin | no | CW-1 | $2.9 \times 10^{9}$ | L/L initial | 240 | 160 | AA | 1.50 | A | A | |
| | | | | | N/N initial | 254 | 170 | AA | 1.48 | A | A | |
| | | | | | H/H initial | 271 | 182 | AA | 1.45 | A | A | A |
| | | | | | After N/N run. | 259 | 173 | AA | 1.42 | A | A | |
| | | | | | After DCT* (N/N) | 276 | 186 | AA | 1.32 | A | A | |
| Example 38: | | | | | | | | | | | | |
| NBR rubber | Aqueous amide resin | Melamine type | no | $1.6 \times 10^{9}$ | L/L initial | 263 | 199 | AA | 1.50 | A | A | |
| | | | | | N/N initial | 330 | 228 | AA | 1.45 | A | A | |
| | | | | | H/H initial | 500 | 395 | AA | 1.40 | A | A | A |
| | | | | | After N/N run. | 289 | 220 | AA | 1.41 | A | A | |
| | | | | | After DCT* (N/N) | 291 | 225 | AA | 1.46 | A | A | |
| Example 39: | | | | | | | | | | | | |
| NBR rubber | Aqueous urethane resin | no | no | $1.1 \times 10^{9}$ | L/L initial | 302 | 244 | AA | 1.49 | A | A | |
| | | | | | N/N initial | 354 | 270 | AA | 1.42 | A | A | |
| | | | | | H/H initial | 646 | 479 | AA | 1.35 | A | A | C |
| | | | | | After N/N run. | 327 | 234 | AA | 1.35 | A | A | |
| | | | | | After DCT* (N/N) | 2,480 | 1,742 | C* | 1.20 | A | C | |

*Drum contamination test

TABLE 7

| Layer configuration | | | | | | Evaluation items | | | | | | |
|---|---|---|---|---|---|---|---|---|---|---|---|---|
| | surface layer | | | | | Product electric = current values | | Image reproduction | | | | DCT* |
| Elastic layer | Binder | Cross = linking agent | Hydrophilic powder | Volume resistivity (Ω · cm) | Conditions | AC (μA) | DC (μA) | (1) | (2) | (3) | (4) | (5) |
| Example 44: | | | | | | | | | | | | |
| Hydrin rubber | Aqueous amide resin | Melamine type | CW-1 | $2.6 \times 10^9$ | L/L initial | 235 | 158 | AA | 1.51 | A | A | |
| | | | | | N/N initial | 237 | 160 | AA | 1.49 | A | A | |
| | | | | | H/H initial | 242 | 164 | AA | 1.48 | A | A | A |
| | | | | | After N/N run. | 239 | 160 | AA | 1.43 | A | A | |
| | | | | | After DCT* (N/N) | 239 | 161 | AA | 1.49 | A | A | |
| Example 45: | | | | | | | | | | | | |
| Hydrin rubber | Aqueous amide resin | Melamine type | no | $1.6 \times 10^9$ | L/L initial | 263 | 199 | AA | 1.50 | A | A | |
| | | | | | N/N initial | 330 | 228 | AA | 1.48 | A | A | |
| | | | | | H/H initial | 500 | 395 | AA | 1.43 | A | A | A |
| | | | | | After N/N run. | 289 | 220 | AA | 1.41 | A | A | |
| | | | | | After DCT* (N/N) | 511 | 402 | AA | 1.32 | A | A | |
| Example 46: | | | | | | | | | | | | |
| Silicone rubber | Aqueous amide resin | Melamine type | CW-1 | $2.7 \times 10^9$ | L/L initial | 233 | 156 | A | 1.51 | A | A | |
| | | | | | N/N initial | 235 | 158 | A | 1.49 | A | A | |
| | | | | | H/H initial | 240 | 162 | A | 1.48 | A | A | A |
| | | | | | After N/N run. | 236 | 158 | A | 1.43 | A | A | |
| | | | | | After DCT* (N/N) | 237 | 159 | A | 1.49 | A | A | |
| Example 47: | | | | | | | | | | | | |
| Silicone rubber | Aqueous amide resin | Melamine type | no | $1.0 \times 10^9$ | L/L initial | 302 | 244 | A | 1.49 | A | A | |
| | | | | | N/N initial | 354 | 270 | A | 1.44 | A | A | |
| | | | | | H/H initial | 646 | 479 | A | 1.39 | A | A | A |
| | | | | | After N/N run. | 327 | 234 | A | 1.41 | A | A | |
| | | | | | After DCT* (N/N) | 750 | 512 | A* | 1.20 | A | A | |

What is claimed is:

1. A charging member for electrophotography comprising: a support and a functional layer as a surface layers;

said functional layer comprising a semiconducting member which is formed by applying a solution containing a water-soluble polyaniline having an acidic group and a water-soluble or emulsion-forming polymeric compound, followed by drying;

said semiconducting member having a volume resistivity of from $10^4$ Ω·cm to $10^{12}$ Ω·cm.

2. A charging member for electrophotography according to claim 1, wherein said acidic group is a sulfonyl group.

3. A charging member for electrophotography according to claim 1, wherein said water-soluble or emulsion-forming polymeric compound is the water-soluble polymeric compound.

4. A charging member for electrophotography according to claim 3, wherein said water-soluble polymeric compound is a water-soluble amide resin.

5. A charging member for electrophotography according to claim 1, wherein said water-soluble or emulsion-forming polymeric compound is the emulsion-forming polymeric compound.

6. A charging member for electrophotography according to claim 5, wherein said emulsion-forming polymeric compound is a urethane resin, a styrene-acrylic resin or an acrylic resin.

7. A charging member for electrophotography according to claim 1, wherein said semiconducting member is cross-linked by a cross-linking agent.

8. A charging member for electrophotography according to claim 7, wherein said cross-linking agent is hydrophilic.

9. A charging member for electrophotography according to claim 7, wherein said cross-linking agent is a melamine compound or an epoxy compound.

10. A charging member for electrophotography according to claim 1, wherein said water-soluble or emulsion-forming polymeric compound has a cross-linking reactive group.

11. A charging member for electrophotography according to claim 1, wherein said semiconducting member further includes a hydrophilic powder.

12. A charging member for electrophotography according to claim 11, wherein said hydrophilic powder is carbon black.

13. A charging member for electrophotography according to claim 11, wherein said hydrophilic powder is carbon black having been surface-oxidized.

14. A charging member for electrophotography according to claim 7, wherein said semiconducting member further includes a hydrophilic powder.

15. A charging member for electrophotography according to claim 1, wherein said charging member is a charging roller.

16. A process cartridge comprising: an electrophotographic photosensitive member and a charging member;

said electrophotographic photosensitive member and said charging member being supported as one unit and being detachably mountable to the main body of an electrophotographic apparatus;

said charging member comprising a support and a functional layer as a surface layer;

said functional layer comprising a semiconducting member which is formed by applying a solution containing a water-soluble polyaniline having an acidic group and a water-soluble or emulsion-forming polymeric compound, followed by drying; and said semiconducting member having a volume resistivity of $10^4$ Ω·cm to $10^{12}$ Ω·cm.

* * * * *

UNITED STATES PATENT AND TRADEMARK OFFICE

CERTIFICATE OF CORRECTION

PATENT NO. : 6,432,324 B1
DATED : August 13, 2002
INVENTOR(S) : Tatsurou Yoshida et al.

It is certified that error appears in the above-identified patent and that said Letters Patent is hereby corrected as shown below:

Drawings,
Sheet 4, FIG. 6, "SOURSE" should read -- SOURCE --.

Column 1,
Line 18, "elastic-rollers" should read -- elastic rollers --.

Column 3,
Line 63, "group ii) and" should read -- group and ii) --.

Column 5,
Line 6, "pyrtolidones," should read -- pyrrolidones, --.

Column 7,
Line 54, "member." should read -- member is not entirely clear. --.

Column 12,
Line 21, "LIL" should read -- L/L --; and
Line 34, "LIL," should read -- L/L, --.

Column 16,
Line 29, "go polyaniline" should read -- polyaniline --.

Column 17,
Line 45, "letter" should read -- Letter --.

Column 31,
Line 40, "layers;" should read -- layer; --; and
Line 46, "drying;" should read -- drying; and --.

Signed and Sealed this

Twenty-second Day of July, 2003

JAMES E. ROGAN
*Director of the United States Patent and Trademark Office*